US007351188B2

(12) United States Patent
Schaller et al.

(10) Patent No.: US 7,351,188 B2
(45) Date of Patent: Apr. 1, 2008

(54) HOODED RECLOSABLE PACKAGES AND RELATED METHODS OF MANUFACTURE

(75) Inventors: Stephen P. Schaller, Manteno, IL (US); Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 603 days.

(21) Appl. No.: 10/913,725

(22) Filed: Aug. 5, 2004

(65) Prior Publication Data

US 2006/0030471 A1 Feb. 9, 2006

(51) Int. Cl.
*B31B 1/84* (2006.01)

(52) U.S. Cl. ..... 493/213; 493/214; 493/212; 493/927; 53/133.4; 53/139.2; 383/64; 383/5; 156/66; 24/64

(58) Field of Classification Search ..... 493/212–214, 493/927; 53/412, 133.4, 139.2; 383/5, 63, 383/64, 61.3, 203, 204, 207; 156/66; 24/64
See application file for complete search history.

(56) References Cited

U.S. PATENT DOCUMENTS

| | | | | |
|---|---|---|---|---|
| 3,022,613 | A * | 6/1962 | Powers | 53/450 |
| 3,182,430 | A * | 5/1965 | Hoeppner | 53/455 |
| 4,015,771 | A * | 4/1977 | Sengewald | 383/203 |
| 4,874,257 | A | 10/1989 | Inagaki | 383/63 |
| 4,894,975 | A | 1/1990 | Ausnit | 53/412 |
| 4,927,271 | A * | 5/1990 | Branson | 383/5 |
| 5,063,639 | A | 11/1991 | Boeckmann et al. | 24/30.5 R |
| 5,092,684 | A | 3/1992 | Weeks | 383/61 |
| 5,121,997 | A * | 6/1992 | La Pierre et al. | 383/203 |
| 5,186,543 | A * | 2/1993 | Cochran | 383/203 |
| 5,334,127 | A * | 8/1994 | Bruno et al. | 493/194 |
| 5,337,539 | A * | 8/1994 | Barton | 53/413 |
| 5,609,420 | A | 3/1997 | Palmisano | 383/203 |
| 5,904,425 | A * | 5/1999 | May | 383/203 |
| 6,389,780 | B1 | 5/2002 | Coomber et al. | 53/412 |
| 6,428,208 | B1 * | 8/2002 | Addison et al. | 383/23 |

* cited by examiner

*Primary Examiner*—Hemant M. Desai
(74) *Attorney, Agent, or Firm*—Ostranger Chong Flaherty & Broitman P.C.

(57) ABSTRACT

A reclosable package comprising a hooded zipper with a pair of off-center lines of perforations that are hermetically sealed by a layer of material. The lines of perforations facilitate tearing off the hood to gain access to the zipper. One method of manufacture involves joining the hooded zipper to respective web portions formed by folding a web and then slitting the folded web in two. Another method of manufacture involves joining the hooded zipper to respective web portions formed by slitting a web in two and then orienting the two web portions into mutually confronting positions. The package may be constructed to have a wicket flap.

13 Claims, 5 Drawing Sheets

HOODED RECLOSABLE PACKAGES AND RELATED METHODS OF MANUFACTURE

BACKGROUND OF THE INVENTION

This invention generally relates to reclosable bags having features that provide evidence of tampering. In particular, the invention relates to reclosable bags having a hood that shrouds or covers the zipper and must be breached in order to access the zipper.

Reclosable bags are finding ever-growing acceptance as primary packaging, particularly as packaging for foodstuffs such as cereal, fresh fruit and vegetables, cold cuts, snacks and the like. Such bags provide the consumer with the ability to readily store, in a closed, if not sealed, package any unused portion of the packaged product even after the package is initially opened.

Reclosable bags comprise a receptacle having a mouth with a plastic zipper for opening and closing. Typically, a zipper for a reclosable bag includes a pair of interlockable profiled closure strips that are joined at opposite ends of the bag mouth. The profiles of interlockable plastic zipper strips can take on various configurations, e.g. interlocking rib and groove elements having so-called male and female profiles, interlocking alternating hook-shaped closure elements, etc.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper inside an enclosed header on the top of the bag. Another type of tamper-evident feature is the provision of a membrane on the product side of the zipper that partitions the interior volume in an airtight manner.

In the formation of reclosable plastic bags when the bags are used for foodstuffs and like material, it is advantageous to have the bags supplied with a tamper-evident seal which not only protects the contents from the ingress of foreign materials and contamination, but also shows if inadvertent or intentional opening has occurred prior to the bag and its contents being in the possession of the buyer. Such a protective seal if formed continuous externally of the reclosable seal rather than internally, can additionally protect the reclosable zipper elements from dust and dirt and other contaminants with a permanent protective seal located outwardly of the reclosable seal, moisture and other foreign elements cannot enter the bag and the purchaser can see that he is obtaining a previously unopened and unused bag where the contents are fully protected. This conveys a feeling of safety and comfort to the purchaser who may be concerned about someone criminally obtaining access to the bag and placing dangerous contaminants into the contents.

There is a continuing need for new designs for reclosable bags with tamper-evident features for hermetic and non-hermetic packages that can be manufactured at low cost.

BRIEF DESCRIPTION OF THE INVENTION

The present invention is directed to methods of manufacturing reclosable bags having a hooded zipper. The invention is further directed to the structure of certain reclosable bags having a wicket flap at one end and a hooded zipper at the other end.

One aspect of the invention is a method of manufacturing a reclosable bag, comprising the following steps: (a) slitting a web of bag making film along a line, thereby severing a first portion of the web from a second portion of the web; (b) orienting the first and second web portions to be mutually confronting; (c) joining a first side of a hood of a hooded zipper to the first web portion along a first band-shaped zone, the hood having a generally U- or V-shaped profile; (d) joining a second side of the hood to the second web portion along a second band-shaped zone; (e) cross sealing the first web portion to the second web portion and the first side of the hood to the second side of the hood along first and second lines that are parallel to each other and transverse to the hooded zipper, the first and second lines being disposed at first and second locations respectively; and (f) cutting the first and second web portions and the hooded zipper at the first and second lines, thereby forming an individual bag.

Another aspect of the invention is a reclosable bag comprising: a receptacle comprising mutually confronting first and second walls that are joined at the sides, the first wall comprising a portion that forms one side of a mouth at a first end of the receptacle and the second wall comprising a portion that forms another side of the mouth; a hooded zipper comprising first and second mutually interlockable profiled fastener means respectively joined or connected to mutually confronting portions of a folded web, the mutually confronting portions of the folded web in turn being joined to the portions of the first and second walls respectively; and a flap extending from a second end of the receptacle in a direction away from the mouth, the second end being opposite to the first end.

A further aspect of the invention is a method of manufacturing a reclosable bag, comprising the following steps: (a) folding a web of bag making film; (b) slitting the web along the fold to form first and second edges of first and second web portions respectively; (c) joining a first side of a hood of a hooded zipper to the first web portion along a first band-shaped zone near the first edge, the hood having a generally U- or V-shaped profile; (d) joining a second side of the hood to the second web portion along a second band-shaped zone near the second edge; (e) cross sealing the first web portion to the second web portion and the first side of the hood to the second side of the hood along first and second lines that are parallel to each other and transverse to the hooded zipper, the first and second lines being disposed at first and second locations respectively; and (f) cutting the first and second web portions and the hooded zipper at the first and second lines, thereby forming an individual bag.

Yet another aspect of the invention is a method of manufacturing a reclosable bag, comprising the following steps: (a) slitting a web of bag making film along a slit line to form first and second edges of first and second web portions respectively; (b) orienting the first and second web portions to confront each other in respective generally vertical positions; (c) joining a first side of a hood of a hooded zipper to the generally vertical first web portion along a first band-shaped zone near the first edge, the hood having a generally U- or V-shaped profile; (d) joining a second side of the hood to the generally vertical second web portion along a second band-shaped zone near the second edge; (e) cross sealing the first web portion to the second web portion and the first side of the hood to the second side of the hood along first and second lines that are parallel to each other and transverse to the hooded zipper, the first and second lines being disposed at first and second locations respectively; and (f) culling the first and second web portions and the hooded zipper at the first and second lines, thereby forming an individual bag.

A further aspect of the invention is a method of manufacturing a reclosable bag, comprising the following steps: (a) slitting a web of bag making film having mutually parallel first and second edges along a line that is generally parallel to the first and second edges, thereby severing a first portion of the web from a second portion of the web, the first web portion having the first edge and a third edge generally parallel to the first edge, and the second web portion having the second edge and a fourth edge generally parallel to the second edge; (b) orienting the first and second web portions to be mutually confronting; (c) joining a first side of a hood of a hooded zipper to the first web portion along a first band-shaped zone disposed near one of the first and third edges, the hood having a generally U- or V-shaped profile; (d) joining a second side of the hood to the second web portion along a second band-shaped zone disposed near one of the second and fourth edges; (e) cross sealing the first web portion to the second web portion and the first side of the hood to the second side of the hood along first and second lines that are parallel to each other and transverse to the hooded zipper, the first and second lines being disposed at first and second locations respectively; and (f) cutting the first and second web portions and the hooded zipper at the first and second lines, thereby forming an individual bag.

Yet another aspect of the invention is a reclosable bag comprising: (a) a receptacle comprising mutually confronting first and second walls that are joined at the sides, the first wall comprising a portion that forms one side of a mouth at a first end of the receptacle and the second wall comprising a portion that forms another side of the mouth; (b) a hooded zipper comprising first and second mutually interlockable profiled fastener means respectively joined or connected to mutually confronting portions of a folded web comprising a line of perforations disposed off center, the mutually confronting portions of the folded web in turn being joined to the aforementioned portions of the first and second walls respectively, and a folded portion of the folded web connecting the mutually confronting portions of the folded web being disposed away from the mouth; and (c) a band of material that covers and seals the perforations in the folded web.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
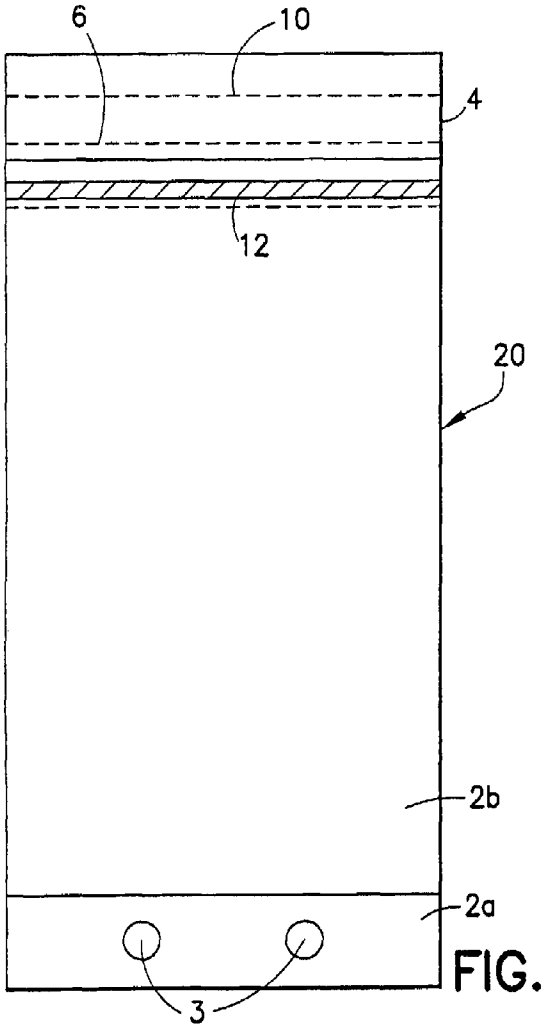
FIG. 1 is a drawing showing a front view of a reclosable package having a hooded zipper at one end and a wicket flap at the other end in accordance with one embodiment of the present invention.

A reclosable package in accordance with one embodiment of the invention is shown in FIG. 1. The package comprises a receptacle 20 having a hooded zipper 4 at one end and a wicket flap at the opposite end. The receptacle comprises a rear wall 2*a* and a front wall 2*b*. Each of the front and rear walls is generally rectangular. The front and rear walls have the same width from side to side, but different heights from top to bottom. The top edges of the front and rear walls 2*b* and 2*a* are generally aligned, while the rear wall 2*a* extends beyond the bottom edge of the front wall 2*b*, as shown in FIG. 1, to form a generally rectangular wicket flap. The flap extends from the bottom of the receptacle in a direction away from the zipper. The flap has a width equal to the width of the receptacle. The wicket flap has a pair of circular holes 3 that are spaced apart along a line running generally parallel to the zipper. These holes 3 can be penetrated by a pair of posts or hangers. Multiple bags can be mounted to the posts or hangers for product display. Slits can be used instead of holes.

The walls 2*a* and 2*b* are heat sealed to each other along the sides of the receptacle. The package depicted in FIG. 1 is open at the bottom (see FIG. 4, which shows a stage in the manufacture of the package depicted in FIG. 1). Later, after the package has been filled with product, the margin of the wall 2*b* will be heat sealed to wall 2*a* in a band-shaped zone that extends across the full width of the receptacle, thereby sealing the package.

Figure 4:
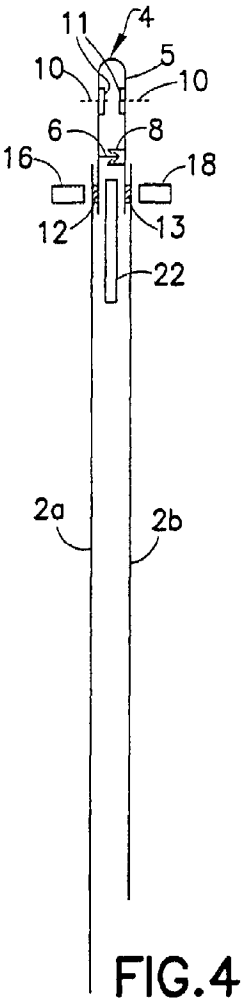
FIGS. 2-4 are drawings showing sectional views of respective stages of a first method for manufacturing the package depicted in FIG. 1.

The hooded zipper 4 comprises a web 5 and a pair of interengageable zipper profiles 6 and 8, seen in FIG. 4, attached to the web 5. An upper major portion of the folded web 5 (i.e., the portion disposed above the zipper profiles in FIG. 4) forms a hood that denies access to the zipper. The hooded zipper 4 is cut from a continuous length of extruded thermoplastic material, with the zipper profiles 6, 8 being extruded onto the already extruded web 5. Alternatively, the zipper profiles can be extruded separately and then attached to the web. When the web 5 is flat, the zipper profiles project from the same side of the web, the zipper profiles 6, 8 being parallel to and spaced apart from each other.

To gain access to the contents of the filled package, the user must first tear off the top of the hood and then open the zipper to gain access to the interior volume of the receptacle. To facilitate tearing off the top portion of the hood, the web 5 is provided with a pair of lines of spaced perforations running the length of the membrane and parallel to the zipper profiles 6, 8. When the web 5 is flat, the perforated lines are disposed between the zipper profiles. Furthermore, in accordance with one embodiment, each line of perforations is capped by a respective sealing stripe 11 (see FIG. 4), as taught in U.S. Pat. No. 5,063,639. The sealing stripe 11 may be heat sealed to the web in a band-shaped zone that extends on both sides of the respective perforated line. The sealing stripe 11 effectively hermetically seals the perforations 10 while still leaving the line of weakened tear resistance provided by the perforations. Alternatively, a single, wider sealing stripe may be used to cover both tear lines 10.

After the flat web has been perforated and the perforations have been sealed, the web/zipper extrusion or assembly is folded in a central region (e.g., along a midline of web 4) so that the zipper profiles are brought into alignment with each other, i.e., the fold line is parallel to the zipper profiles. [The lines of perforations 10 are disposed on the web 5 to be at approximately the same elevation when the web 5 is folded.] Then the aligned zipper profiles 6, 8 are interlocked to close the zipper. As seen in FIG. 4, the hood comprises a loop of web material having a U-shaped profile. Alternatively, the folded profile of the hood can be V-shaped. The resulting continuous tape is then wound on a supply reel, to be paid out later during automated manufacture of the package.

Figure 11:
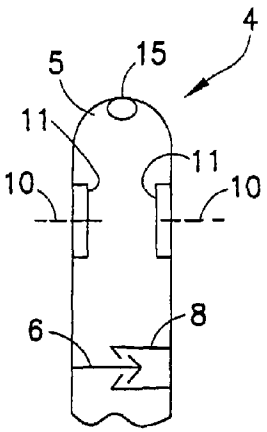
FIG. 11 is a drawing showing a sectional view of a hooded zipper having a tear bead.

In accordance with one embodiment of the hooded zipper 4 shown in FIG. 11, a tear bead 15 may be extruded or attached along a centerline of the web 5, on the same side of web 5 to which the zipper profiles 6, 8 are attached. When the web 5 is folded and the zipper profiles are interlocked, the tear bead 15 will be disposed at the apex of the hood, as seen in FIG. 11. The tear bead 15 makes it easier for the consumer to grab and pull off the separable portion of the hood.

Figure 2:
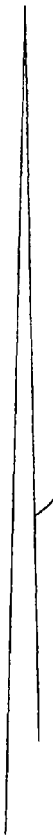

Packages of the type depicted in FIG. 1 can be manufactured on a machine. Three stages of one method of manufacture are respectively depicted in FIGS. 2 through 4. In one stage, a web 2 of packaging film having mutually parallel lateral edges is folded along a line parallel to but offset from a centerline of the web, as seen in FIG. 2. Either a web is paid from a supply roll and then folded, or a folded web is paid out from a supply roll. In the next stage shown in FIG. 3, the web 2 is slit along the fold by a cutting device 14, such as a knife or other blade. After slitting, the edges of the respective web portions 2*a* and 2*b* formed upon slitting are maintained in alignment and opposition to each other with a gap therebetween. The wicket holes 3 can be punched at any other point in the manufacturing process.

During the next stage of manufacture, a section of a continuous length of hooded zipper tape 4 is guided into a position whereby the respective marginal portions of the web 5 (below the zipper profiles) are inserted between (i.e., inside) the respective marginal web portions adjacent the edges formed by the slit, as seen in FIG. 4. The overlapping marginal portions of the web portions and the hooded zipper are disposed on opposite sides of a separating plate 22. More specifically, a marginal portion on one side of the web 5 and a marginal portion of web portion 2*a* pass through a gap between the separating plate 22 and a first heated sealed bar 16, while a marginal portion on the other side of web 5 and a marginal portion of web portion 2*b* pass through a gap between the separating plate 22 and a second heated sealing bar 18. The sealing bars are shown in FIG. 4 (and also in FIGS. 6 and 9) in their retracted positions. Typically, each sealing bar is made of a metal that conducts heat well, the metal bar being electrically heated. In accordance with one embodiment, the sealing bars are reciprocatable between retracted and extended positions by means of any conventional linear displacement means. One well-known linear displacement means suitable for the intended purpose is a double-acting air cylinder, i.e., a cylinder having one air intake that causes a piston to extend and another air intake that causes the piston to retract. The heated sealing bar is mounted to the end of the piston rod. When the marginal portions of the web 5 and the web portions 2*a*, 2*b* are in the above-described positions, the heated sealing bars 16 and 18 are extended. In its extended position, the sealing bar 16 presses respective portions of web 5 and web portion 2*a* against the separating plate, and applies sufficient heat and pressure to cause the thermoplastic material of these portions to soften or melt in a band-shaped zone as wide as the sealing bar 16. Then when the sealing bar 16 is retracted, the softened or melted material fuses to form a permanent heat seal 12 in the band-shaped zone that joins web portion 2*a* to one side of the hood. At the same time and in the same way, the heated sealing bar 18 is extended to form a permanent heat seal 13 in a band-shaped zone that joins web portion 2*b* to the other side of the hood. The separating plate 22 prevents the seal through of the two sides of the web 5 to each other during the heat sealing operation. In accordance with an alternative embodiment, continuous motion sealers, called "drag sealers", can be used.

The remaining stages of the first method of manufacture are conventional and not shown in the drawings. After each section of continuous hooded zipper tape 4 has been attached to respective sections of web portions 2*a* and 2*b*, as depicted in FIG. 4, the web portions 2*a* and 2*b* are cross sealed (i.e., sealed along lines transverse to the zipper profiles) to each other and the two sides of the hooded zipper are cross sealed to each other at regular intervals along the length of the web/hooded zipper assembly to form a chain of pockets. The web/hooded zipper assembly can also be severed during the cross sealing operation by using a hot knife to sever and seal the thermoplastic materials. Alternatively, the web portions 2*a*, 2*b* and the opposing sides of the hooded zipper can be cross sealed (e.g., joined by conductive heat sealing using a heated sealing bar) in transverse band-shaped zones and then respective packages are severed from the remainder of the work in process by cutting along transverse lines that respectively intersect the transverse band-shaped zones of joinder. Each severed package is open at the end opposite the hooded zipper and ready to be filled with product. Alternatively, before severing each package, the pocket is filled with product and then a portion of web portion 2*b* near its bottom edge is sealed (e.g., joined by conductive heat sealing using a heated sealing bar) to a confronting portion of web portion 2*a* along a band-shaped zone, thereby sealing the interior volume of the receptacle. Then the filled package is severed from the work in process.

Figure 5:
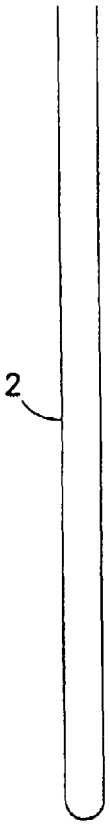

Various stages of a second method of manufacturing the package depicted in FIG. 1 are respectively depicted in FIGS. 5 through 8. In accordance with this method, a web 2 of packaging film having mutually parallel lateral edges is folded along a centerline, i.e., a line midway between and parallel to the lateral edges, as shown in FIG. 5. Either a web is paid from a supply roll and then folded, or a folded web is paid out from a supply roll.

Figure 6:
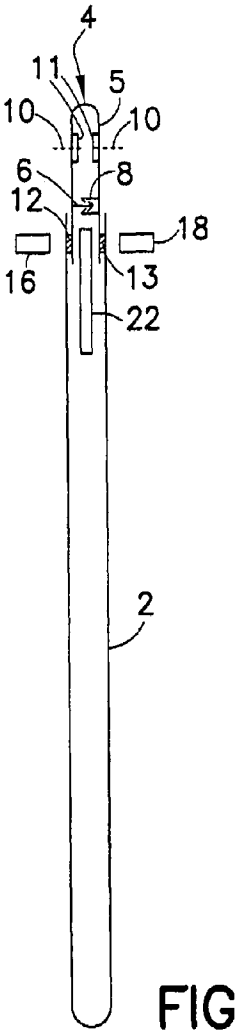

During the next stage of manufacture depicted in FIG. 6, a section of a continuous length of hooded zipper tape 4 is guided into a position whereby the respective marginal portions of the web 5 are inserted between (i.e., inside) the respective marginal web portions of the folded web 2. The overlapping marginal portions of the folded web and hooded zipper are disposed on opposite sides of a separating plate 22, with respective first portions the web 5 and the folded web 2 disposed between the separating plate 22 and a first heated sealed bar 16, and with respective second portions the web 5 and the folded web 2 disposed between the separating plate 22 and a second heated sealing bar 18. In their extended positions, the heated sealing bars 16 and 18 press respective portions of webs 2 and 4 against the separating plate, and apply sufficient heat and pressure to cause the thermoplastic material of these portions to soften or melt.

Then when the sealing bars are retracted, the softened or melted material fuses to form permanent heat seals 12 and 13 in respective band-shaped zones. The separating plate 22 prevents seal-through of two sides of web 5 of the hooded zipper.

Figure 8:
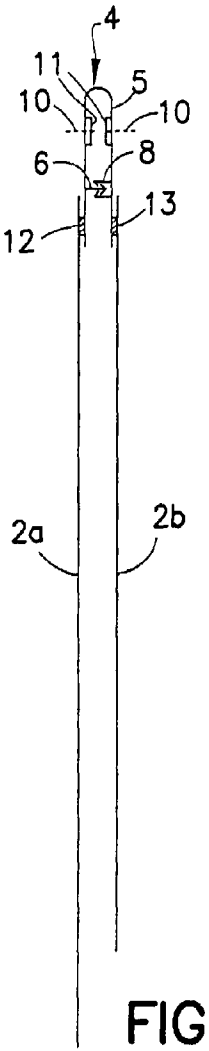
FIGS. 5-8 are drawings showing sectional views of respective stages of a second method for manufacturing the package depicted in FIG. 1.
Figure 7:
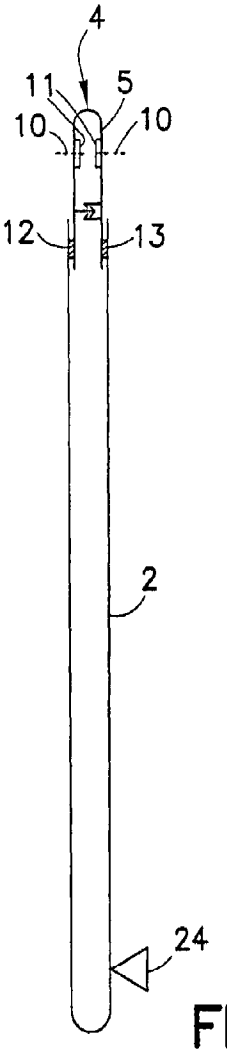

After attachment of the hooded zipper to the folded web 2, the web 2 is slit, along a line that is offset from the centerline of the web, by a cutting device 24, such as a knife or other blade. An exemplary location for the slit is indicated by the location of cutting device 24 in FIG. 7. The result of the slitting operation is two web portions 2*a* and 2*b*, each having a respective portion joined to a respective portion of the web 5, as depicted in FIG. 8. The subsequent stages of the second method of manufacture may be the same as those previously described for the first method of manufacture, including cross sealing the web portions 2*a* and 2*b* to form receptacle side seals together and cross sealing the two sides of the hooded zipper together to form hooded zipper end seals aligned with the receptacle side seals, and severing each package from the work in process.

Figure 9:
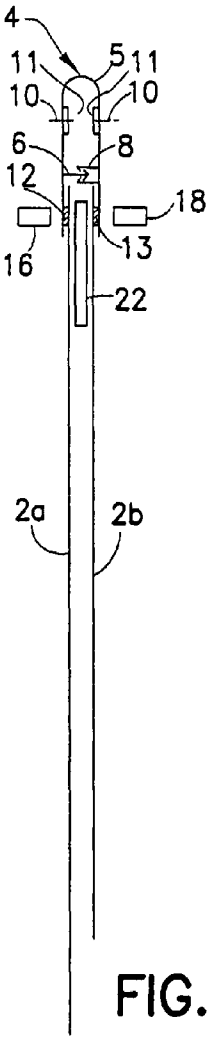
FIG. 9 is a drawing showing a sectional view of a stage in the manufacture of a package in accordance with an alternative embodiment of the invention.

In accordance with an alternative to the first method of manufacture, the marginal portions of the web 5 of a hooded zipper are placed outside the marginal portions of web portions 2*a* and 2*b* after the web has been slit and prior to joining the web portions to the sides of the hooded zipper, as depicted in FIG. 9. In this case, the separating plate 22 prevents seal-through of the web portions 2*a* and 2*b* during the heat sealing operation.

In accordance with an alternative to the second method of manufacture (not shown in the drawings), the marginal portions of at web of a hooded zipper are placed outside the marginal portions of a folded web prior to joining the web portions to the sides of the hooded zipper and prior to slitting the web of packaging film.

In accordance with further alternative methods of manufacture, instead of using a separating plate to prevent seal-through during the heat sealing operation, the confronting surfaces of the innermost web portions can be coated with layers of non-sealant material, i.e., material that will not soften or melt during the heat sealing operation. For example, for the cases depicted in FIGS. 4 and 6, wherein the marginal portions of the web 5 of the hooded zipper are placed between the marginal portions of walls of the package, the non-sealant coating is applied on the mutually confronting surfaces of the marginal portions of web 5. In the case depicted in FIG. 9, the non-sealant coating is applied on the mutually confronting surfaces of the marginal portions of web portions 2*a* and 2*b*.

Figure 10:
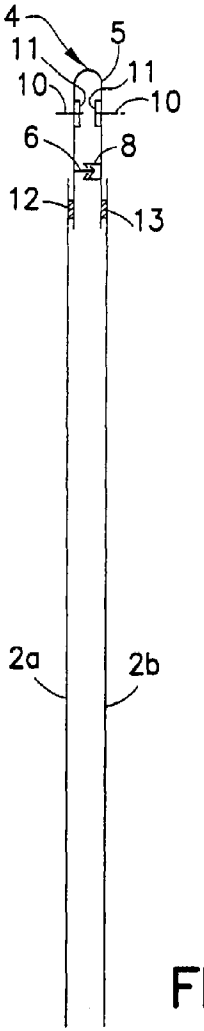
FIG. 10 is a drawing showing a sectional view of a package in accordance with an embodiment constructed without a wicket flap.

The embodiments disclosed above each have a wicket flap. However, another aspect of the invention is the manufacture of packages having hooded zippers and not having a wicket flap. This can be accomplished by slitting the web along its centerline instead of along a line offset from the centerline. A sectional view of such a package (open at the bottom) is shown in FIG. 10.

Figure 12:
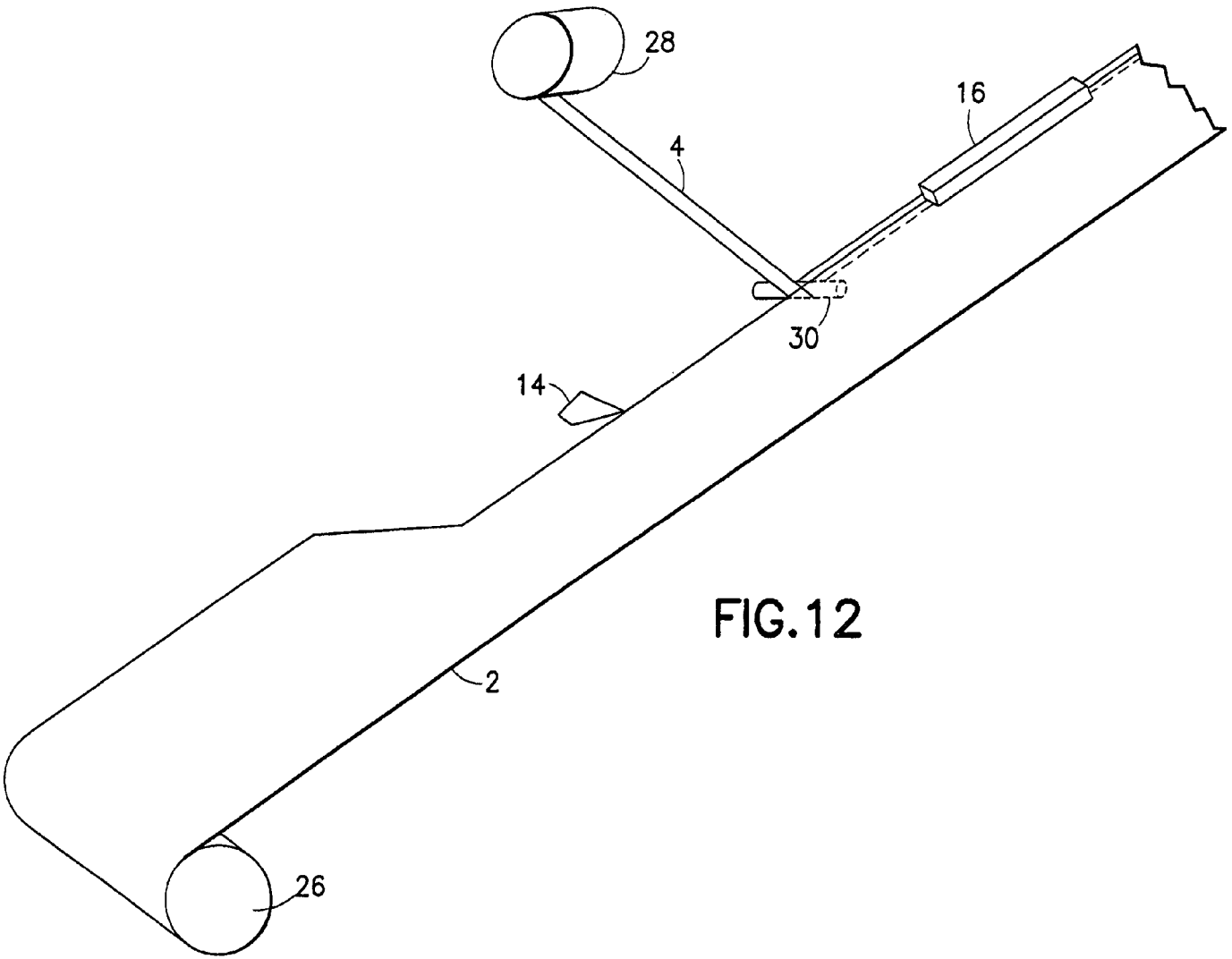
FIG. 12 is a drawing showing an exemplary implementation of the first method of manufacture.

FIG. 12 is a drawing showing an exemplary implementation of the method of manufacture previously described with reference to FIGS. 2-4. The web 2 is paid out from a supply roll 26 in a generally horizontal plane and folded by a folding board (not shown). Although FIG. 12 depicts one web portion being folded 180° relative to the other web portion. Typically, however, both portions of the web are turned 90°, but in opposite directions, the end result being two vertically oriented web portions with the fold at the top. The folded web is then slit along the fold by a cutting device 14, as previously described. The hooded zipper tape 4 is paid out from a spool 28 and guided around a 90° turn bar 30 into the space between the marginal portions formed as the result of slitting the web 2. Then the sides of the web of the hooded zipper tape (below the zipper profiles) are joined to the respective portions of the slit web of packaging film by a pair of heated sealing bars (only one of which, item 16, is shown in FIG. 12) with a separating plate (not shown in FIG. 12) therebetween. The apparatus for performing the additional steps of the first method of manufacture are also not shown in FIG. 12. Such apparatus includes wicket hole punches, cross-sealing jaws and cutting blades for severing packages from the work in process.

The system described in the preceding paragraph can be used to make pouches for filling later. Alternatively, a chain of pouches, open at one end and with a hooded zipper at the other end, can be fed directly into a form-fill-seal machine. Upstream of the cross-sealing jaws, the web can be advanced either continuously or intermittently. Cross sealing is typically performed during dwell times.

Figure 13:
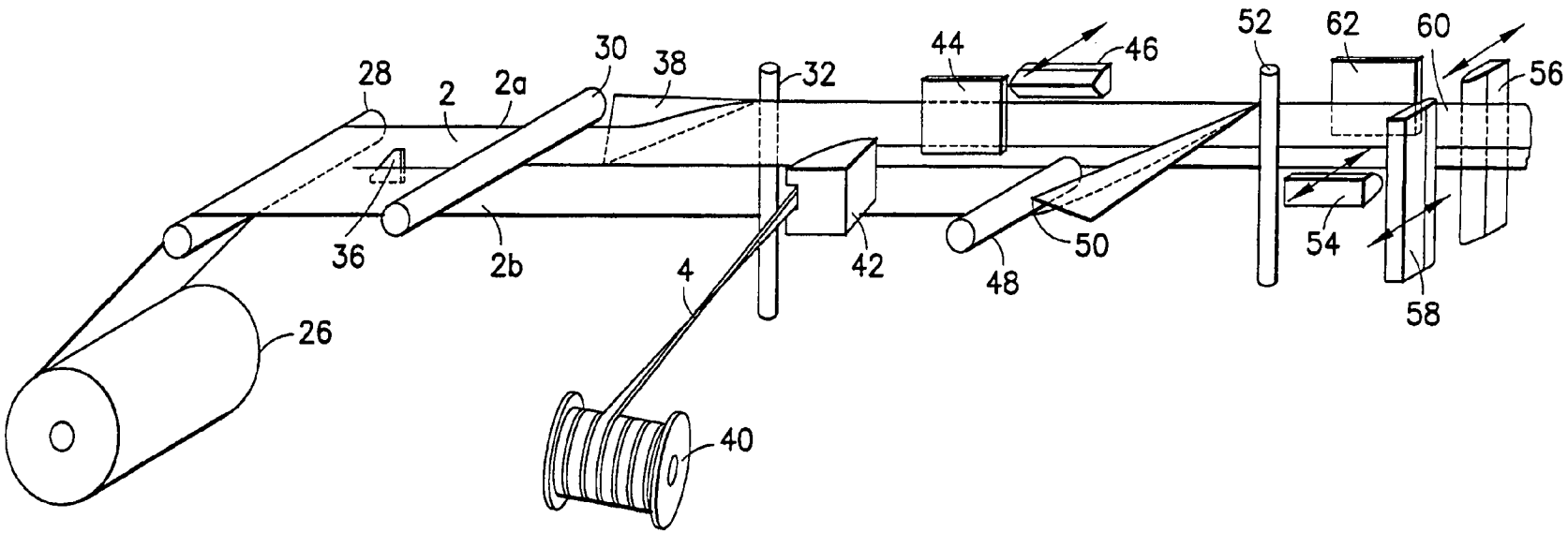
FIG. 13 is a drawing showing an exemplary implementation of the second method of manufacture.

FIG. 13 is a drawing showing an exemplary implementation of the second method of manufacture. FIG. 13 depicts a machine similar to a machine shown in FIGS. 1 and 2 of U.S. Pat. No. 6,389,780. A web of thermoplastic packaging film 2 is supplied in a continuous stream to the machine from a supply roll 26. The film web 2 is guided by a web guiding mechanism comprising a pair of rollers 28 and 30. The machine further comprises a knife or blade 36 for cutting the web 2 into two web portions 2*a* and 2*b* that eventually become the respective walls of a succession of bags. In this embodiment, the blade 36 is positioned at the centerline of the machine so that web portions 2*a* and 2*b* have equal width, which would be the blade position used to make bags of the type shown in FIG. 10. To make bags of the type shown in FIG. 4 (i.e., having a wicket flap), it would be necessary to move the blade off center, so that the resulting web portions 2*a* and 2*b* are unequal in width.

Downstream of the blade 36, the web portion 2*a* is folded or turned to a vertical orientation relative by a folding plow or board 38 and a vertical guide bar 32. In this configuration, web portion 2*b* remains horizontal and web portion 2*a* is accessible for attachment of a zipper tape 4 of the type previously described. Zipper tape 4 is supplied from a spool 40. A guide 42 is positioned and configured to direct the zipper tape 4 to extend along the lower margin of web portion 2*a*, which will result in a bag that will be filled through its bottom. Downstream of guide 42, the zipper tape 4 is disposed between the lower margin of web portion 2*a* and a backing plate 44. Then a reciprocating heated sealing bar 46, while in an extended position, joins a length of zipper tape 4 to an equal length of the lower margin of web portion 2*a* by conventional conductive heat sealing.

Up to this point in this particular implementation, the web portion 2*b* has traveled in a horizontal path. Downstream of the heating sealing bar 46, however, web portion 2*b* passes under a roller 48 and along a folding plow or board 50 and a vertical guide 52, which fold or turn web portion 2*b* to a vertical orientation, causing the inside surfaces of web portions 2*a* and 2*b* to confront each other. The web portions 2*a* and 2*b* are then advanced to a reciprocating heated sealing bar 54, which seals a length of the lower margin of second web portion 2*b* to a corresponding length of zipper tape 4 against a backing plate 62. Then the web portions 2*a* and 2*b* with the zipper tape 4 joined thereto are advanced to a location between a pair of mutually opposing reciprocating vertical sealing bars 56 and 58 that are extended to engage the web portions 2*a* and 2*b* and form vertical side seals 60. At least one of the sealing bars 56 and 58 is heated.

Following the formation of the side seals 60, the web portions 2*a* and 2*b* with zipper tape 4 joined thereto are advanced to a cutting and filling portion of the machine (not shown in the drawings). This cutting and filling portion of the machine may take many different forms. Two embodiments are shown in FIGS. 3 and 4 of U.S. Pat. No. 6,389,780.

Figure 3:
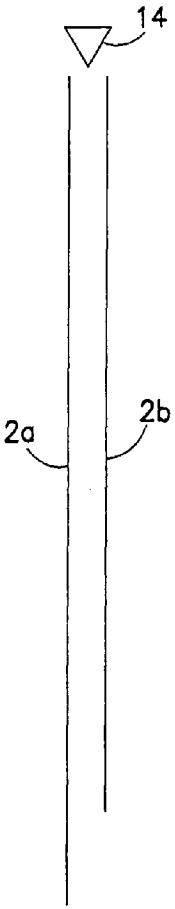

In accordance with one embodiment of the cutting and filling portion of the machine shown in FIG. 3 of U.S. Pat. No. 6,389,780, individual bags are formed by cutting the side seals (60 in FIG. 13 herein) approximately in half with cutting blades (not shown) or other cutting devices. An unsealed end of each bag is then pulled open by vacuum devices (not shown) or similar devices and moved under a filling spout (not shown), which drops product into each bag. Each filled bag is then advanced to a pair of mutually opposing horizontal sealing bars (not shown) that are reciprocated to engage the web portions 2*a* and 2*b* and form a bottom seal. At least one of the horizontal sealing bars is heated.

Alternatively, the unsealed end of each bag precursor is opened by vacuum devices, filled with product, and then sealed by a pair of horizontal sealing bars 74 (shown in FIG. 4 of U.S. Pat. No. 6,389,780). The filled bags are then separated by cutting blades.

In accordance with some embodiments of the invention, the wicket flap is integrally formed with either the front or rear wall of the receptacle. However, the bag shown in FIG. 1 could also be manufactured by forming the flap as a separate panel that is joined to the web of bag making film. Also, instead of starting with a single web that is slit, one could begin with two webs that will be sealed on three sides to form each receptacle.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "package" includes bags, pouches, and any other type of packaging (filled or empty) in which a flexible plastic zipper can be incorporated. Further, in the absence of explicit language in any method claim setting forth the order in which certain steps should be performed, the method claims should not be construed to require that steps be performed in the order in which they are recited.

The invention claimed is:

1. A method of manufacturing a reclosable bag, comprising the following steps:

folding a first web of bag making film;

slitting said first web of bag making film along the fold, thereby severing a first portion of said first web from a second portion of said first web and forming respective edges thereof;

guiding said respective edges of said first and second web portions to position in alignment with and in opposition to each other;

providing a hooded zipper having a hood that is a second web folded to form a U- or V-shaped profile having first and second sides;

placing marginal portions of said first and second sides of the hood of said hooded zipper in position adjacent and overlapping respective marginal portions of said first and second web portion adjacent the edges formed by the slit;

concurrently joining the overlapped marginal portion of the first side of the hood with the first web portion along a first band-shaped zone and the overlapped marginal portion of the second side of the hood with the second web portion along a second band-shaped zone;

cross sealing said first web portion to said second web portion and said first side of said hood to said second side of said hood along first and second lines that are parallel to each other and transverse to said hooded zipper, said first and second lines being disposed at first and second locations respectively; and cutting said first and second web portions and said hooded zipper at said first and second lines, thereby forming an individual bag.

2. The method as recited in claim 1, wherein said slit line lies midway between a pair of mutually parallel edges of said web.

3. The method as recited in claim 1, wherein said slit line is offset to one side of a centerline midway between a pair of mutually parallel edges of said web.

4. The method as recited in claim 3, further comprising the step of forming first and second discontinuities in a portion of said first web portion that extends beyond said second web portion.

5. The method as recited in claim 4, wherein said discontinuities are holes.

6. The method as recited in claim 4, wherein said discontinuities are slits.

7. The method as recited in claim 1, wherein said hood comprises a second web, further comprising the steps of perforating said second web, hermetically sealing said perforations and folding said second web.

8. The method as recited in claim 7, further comprising the steps of forming first and second closure profiles on said second web.

9. The method as recited in claim 8, further comprising the step of forming a tear bead on said second web in a location disposed between said first and second zipper profiles.

10. The method as recited in claim 8, further comprising the steps of interlocking said first and second closure profiles of said hooded zipper prior to said joining step.

11. The method as recited in claim 1, further comprising the step of applying non-sealant material to a surface of said first side of said hood of said hooded zipper or to a surface of said first web portion in an area where said first band-shaped zone of joinder is formed.

12. The method as recited in claim 1, wherein said slitting step comprising the step of advancing said first web of bag making film relative to a stationary slitting blade, further comprising the following steps of guiding said first web portion of said first web of bag making film through a space on one side of a separating plate and guiding said second web portion of said first web of bag making film through a space on another side of said separating plate, said separating plate separating said first and second portions of said first web of bag making film during joining of said zipper thereto.

13. A method of manufacturing a reclosable bag, comprising the following steps:

folding a web of bag making film so that marginal portions of first and second web portions of said folded web are in alignment with and opposition to each other, said first web portion including said fold and said second web portion not including said fold;

providing a hooded zipper having a hood that is a second web folded to form a U- or V-shaped profile having first and second sides;

placing said first and second sides of the hood of said hooded zipper adjacent said marginal portions of said first and second web portions respectively;

joining said first side of said hood to said marginal portion of said first web portion along a first band-shaped zone and said second side of said hood to said marginal portion of said second web portion along a second band-shaped zone;

cutting said web of bag making film to sever said first web portion from said second web portion along a line parallel to and offset from said fold;

cross sealing said first web portion to said second web portion and said first side of said hood to said second side of said hood along first and second lines that are parallel to each other and transverse to said hooded zipper, said first and second lines being disposed at first and second locations respectively; and cutting said first and second web portions and said hooded zipper at said first and second lines, thereby forming an individual bag.

* * * * *